US006739037B2

(12) United States Patent
Birkel

(10) Patent No.: US 6,739,037 B2
(45) Date of Patent: May 25, 2004

(54) APPARATUS FOR INSERTING A FASTENER INTO A PACKING STRIP OR PLATE

(75) Inventor: Thierry Birkel, Vandoeuvre les Nancy (FR)

(73) Assignee: ITW Litec France, Tournus (FR)

( * ) Notice: Subject to any disclaimer, the term of this patent is extended or adjusted under 35 U.S.C. 154(b) by 251 days.

(21) Appl. No.: 09/950,921

(22) Filed: Sep. 13, 2001

(65) Prior Publication Data

US 2002/0035021 A1 Mar. 21, 2002

(30) Foreign Application Priority Data

Sep. 14, 2000 (FR) ..... 00 11704

(51) Int. Cl.[7] ..... B23P 21/00

(52) U.S. Cl. ..... 29/779; 29/789; 29/450; 29/509

(58) Field of Search ..... 206/716; 29/509, 29/788, 820, 789, 450, 430, 243.57, 243.58, 779, 782; 24/20 R, 30; 217/91, 66; 140/74; 100/8

(56) References Cited

U.S. PATENT DOCUMENTS

| | | | | | |
|---|---|---|---|---|---|
| 442,656 | A | * | 12/1890 | Whittlesey | 29/509 |
| 1,400,624 | A | * | 12/1921 | Pierson | 217/66 |
| 1,950,223 | A | * | 3/1934 | Budd | 29/509 |
| 2,839,188 | A | * | 6/1958 | Cipriani et al. | 206/716 |
| 3,048,268 | A | * | 8/1962 | Rocchi et al. | 206/716 |
| 3,133,637 | A | | 5/1964 | Siegler | |
| 3,168,781 | A | * | 2/1965 | Van Gorp | 29/509 |
| 3,171,535 | A | * | 3/1965 | Harris | 206/716 |
| 3,670,399 | A | * | 6/1972 | George | 29/509 |
| 4,059,215 | A | * | 11/1977 | Owen et al. | 29/509 |
| 4,092,394 | A | * | 5/1978 | Dixon | 29/509 |
| 4,125,936 | A | * | 11/1978 | Rozmus | 29/509 |
| 4,571,808 | A | * | 2/1986 | King | 29/268 |
| 5,609,937 | A | * | 3/1997 | Reinstad | 428/122 |

FOREIGN PATENT DOCUMENTS

| | | |
|---|---|---|
| DE | 803375 | 4/1951 |

* cited by examiner

*Primary Examiner*—David P. Bryant
(74) *Attorney, Agent, or Firm*—Lowe Hauptman Gilman & Berner LLP

(57) ABSTRACT

A method and an apparatus are provided for inserting a fastener (3) into a flexible plate or strip (1) which shall act as a packing structure and which has a channel fitted with two lips (2*a,* 2*b*) partly closing the channel, the fastener (3) to be inserted between the lips. The method includes slightly bending the plate or strip (1) transversely to the direction of its channel in a way to spread apart its lips (2*a,* 2*b*), furthermore to insert the fastener (3) and to substantially reflatten the plate or strip (1) in order that the lips (2*a,* 2*b*) shall resume their initial positions.

20 Claims, 2 Drawing Sheets

APPARATUS FOR INSERTING A FASTENER INTO A PACKING STRIP OR PLATE

TECHNICAL FIELD

The invention relates to a method and to an apparatus for inserting a fastener into a flexible strip or plate that shall constitute a packing structure.

BACKGROUND ART

It is known, when packing, to gird the said packing structure—for instance a cardboard structure—with a hoop or the like, illustratively a plastic strip, in order to close or rigidify said packing structure.

This kind rigidification entails the difficulty that the packing structure must be held in place when being hooped and obviously both the packing structure and its hooping means must be handled simultaneously.

SUMMARY OF THE INVENTION

Accordingly the inventor conceived of a method and an apparatus for inserting such a fastener into a flexible plate or strip that shall constitute the packing structure and which is fitted with a channel comprising two lips that partly close said channel, said fastener being inserted between these two lips.

The method of the invention is characterized in that it slightly bends the plate or strip transversely to the channel direction in a way to move apart its lips, in inserting the fastener and in substantially flattening again said plate or strip in order that these lips resume their initial positions.

Moreover, in one embodiment of the present invention, the plate or strip is displaced longitudinally relative to its channel during the transverse bending and flattening operations while illustratively the plate or strip shall be guided before being bent by at least one means inserted into its channel.

The fastener also may be advantageously held in position against the bottom of the channel by depressing it during the re-flattening stage.

Preferably the channel lips shall be crushed after the plate or strip has been re-flattened.

Illustratively the fastener being used in the present invention is in the form of a hoop or the like, even though it also may be in other forms such as cables etc.

To carry out such a method, the invention also proposes an apparatus which is characterized in that it comprises a sub-assembly for slightly transversely bending the plate or strip, further an element inserting the fastener and a sub-assembly re-flattening the plate or strip, as well as elements driving the plate or strip in its channel's longitudinal direction.

In one embodiment mode of the invention, the bending sub-assembly consists of two superposed wheels of which the rims resp. are one substantially concave and one substantially convex surface, the plate or strip being made to pass through said wheels and its channel facing the concave-rim wheel.

In this embodiment, advantageously the element inserting the fastener consists of a guide ramp feeding said fastener, the end of said ramp extending as far as the vicinity of the bending wheels and between them, said fastener moreover being fitted with a circular rib on the concave wheel in order that the rib may press against the fastener during bending.

Preferably the strip re-flattening element comprises straightening fins which pass gradually from an oblique to a substantially plane position, and the apparatus of the invention also comprises a fastener holding-element configured above the straightening fins and optionally in the form of a small bar.

The apparatus of the invention also may comprise an initial holding and guiding element for the plate or strip, which is configured upstream of the bending subassembly as seen in the direction of motion of the plate or strip, and which is a cylinder on which moves said plate or strip, further comprising a roller that rests against the bottom of the channel in said plate or strip. Moreover an aligning guide in the form of a small bar may be configured between the initial holding and guiding element on one hand and the bending sub-assembly on the other.

Advantageously a sub-assembly crushing the channel lips and in the form of compression drums is configured downstream of the re-flattening element.

The elements driving the plate or strip in its longitudinal direction illustratively consist at least in part motors powering at least one of the bending sub-assembly wheels and/or the initial holding and guiding cylinder and/or at least one of the drums crushing the channel lips.

As regards a plate or strip which is additionally fitted with a substantially right-angle flange for the purpose of constituting a bracket, the apparatus of the invention also may be characterized in that the cylinder of the initial holding and guiding element and one of drums of the crushing sub-assembly do comprise a peripheral, circular channel to receive the substantially right-angle flange of the plate or strip.

BRIEF DESCRIPTION OF THE DRAWINGS

The invention is elucidated in the description below which relates to the attached drawings.

DETAILED DESCRIPTION OF THE INVENTION

Figure 1:
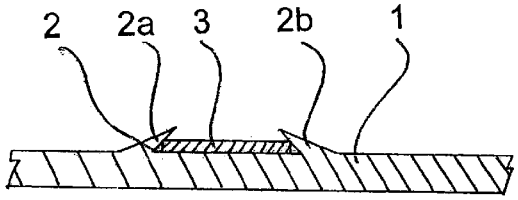
FIG. 1 shows a plate or strip with a hoop inserted into it by the apparatus of the invention.

FIG. 1 shows a flexible plate or strip 1 fitted with a shaped channel 2 comprising two lips 2*a* and 2*b* which partly close said channel 2, a hoop 3 or the like being inserted into this channel. The channel 2 runs straight and longitudinally.

To insert or crimp such a hoop, the invention therefore proposes bending the plate or strip 1 transversely to the direction of its channel 2, to insert the hoop 3 and to re-flatten said plate or strip.

For that purpose the invention proposes the shown apparatus which is displayed especially clearly in FIGS. 2 and 3 and which continuously inserts said fastener in the above described method and of which other features will be discussed below in the description of this apparatus of the invention.

The apparatus of the invention is fitted with an initial holding and guiding sub-assembly comprising a cylinder 4—in this instance it is motor driven as discussed farther below—and a freely rotating roller 5 which is illustratively stressed by a resilient means 6.

Figure 4:
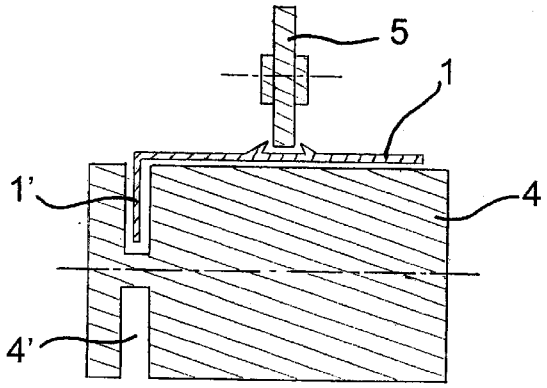
FIGS. 4–8 are sections resp. along IV—IV, V—V, VI—VI, VII—VII, VIII—VIII of FIG. 3.
Figure 5:
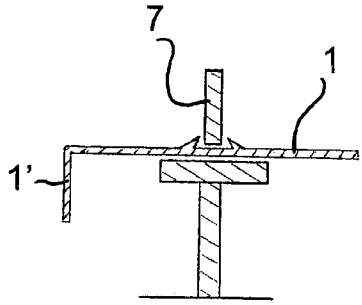

The strip 1 moves between the cylinder 4 and the roller 5 rolling inside the strip channel (FIG. 4).

For clarity's sake, the various components of FIGS. 3 through 8 are not shown being in contact with the strip 1.

Figure 3:
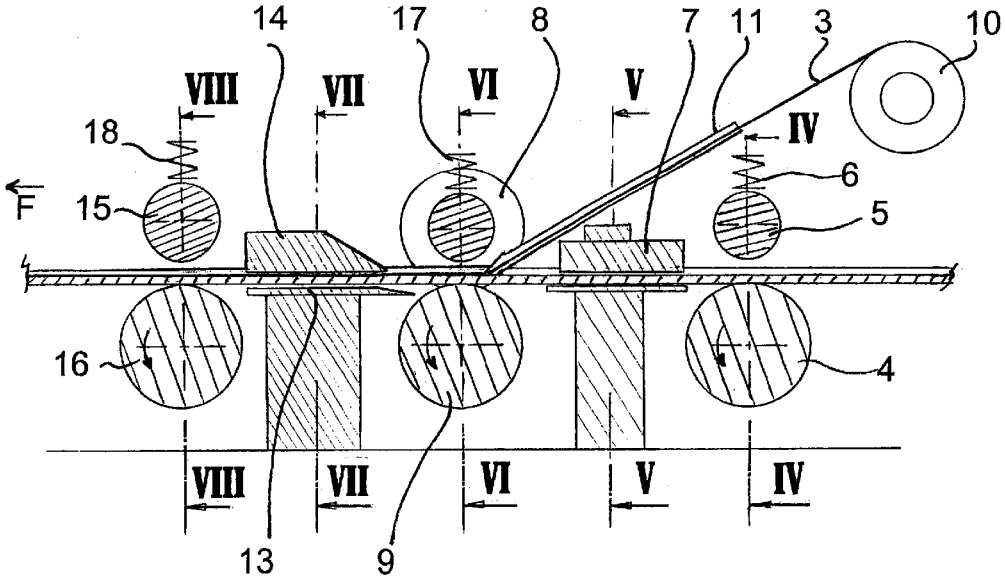
FIG. 3 is a longitudinal section of FIG. 2 along the arrow III and also shows the plate or strip to be processed.

An alignment guide in the form of a small bar 7 received in the channel 2 (FIG. 5) is configured downstream of the cylinder 4 as seen in relation to the strip's direction of advance shown by the arrow F (FIG. 3).

Downstream of the small bar 7, the apparatus of the invention is fitted with the sub-assembly bending the strip 1, in this instance in the form of two superposed wheels 8 and 9 between which passes said strip 1.

Figure 6:
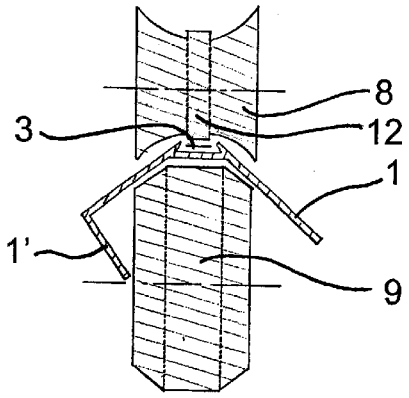
Figure 7:
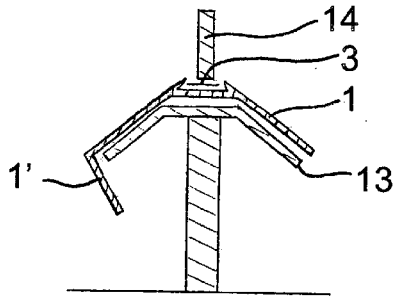
Figure 8:
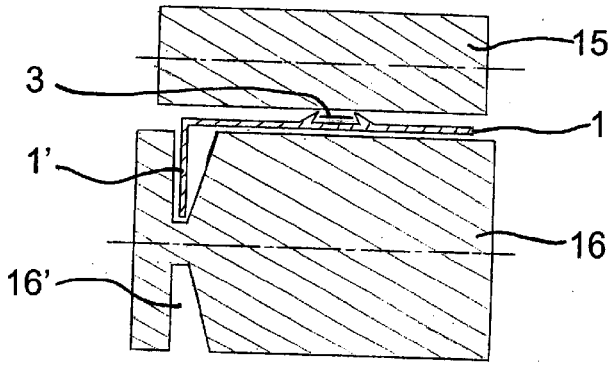

As shown in FIG. 6, the rims of the wheels 8 and 9 resp. exhibit a concave surface (wheel 8) and a substantially convex surface (wheel 9), the channel 2 of the strip 1 facing the concave wheel 8 in such a way that the strip 1 shall be slightly transversely bent as shown in this FIG. 6.

The hoop 3 is fed from a storage means, for instance a coil 10 (FIG. 3) along a guidance ramp 11 (FIGS. 2, 3) of which the end reaches the vicinity of the wheels 8 and 9, whereas said concave wheel 8 is fitted with a central and circular rib 12 (FIG. 6) to support the hoop 3 and to keep it in position in the channel 2.

Figure 2:
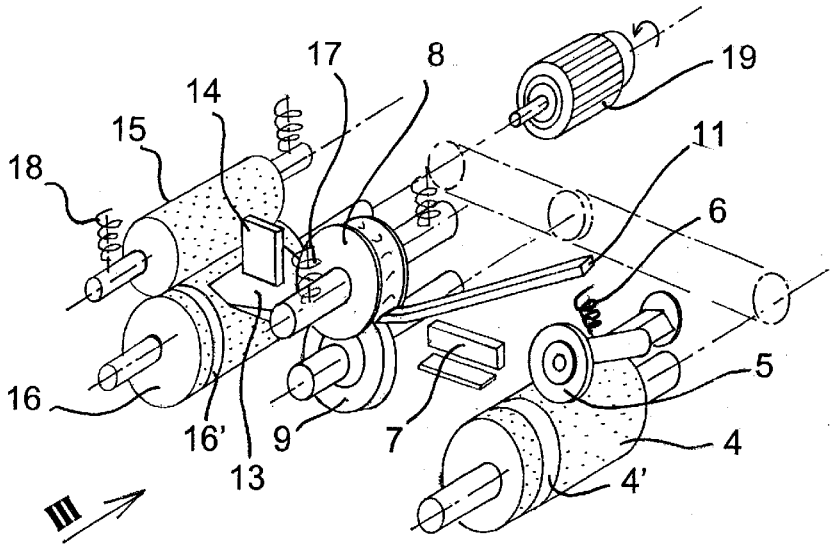
FIG. 2 is a schematic perspective of an apparatus of the invention.

An element re-flattening the strip 1 and in this instance in the form of straightening fins 13 (FIG. 7) is configured in the exit zone of the bending wheels 8 and 9, said fins progressively passing from an oblique position (relative to the horizontal) to a substantially plane position (FIG. 2).

An element in the form of a small bar 14 is configured above the straightening fins to keep the hoop 3 in position.

When leaving the straightening fins 13, the strip 1 therefore is flattened again and is made to pass between two compression drums 15, 16 (FIGS. 2, 3 and 8) to crush the assembly for the purpose of closing again the channel lips 2*a* and 2*b* on the hoop 3.

FIGS. 2 and 3 moreover show that the wheel 8 of the bending sub-assembly and the drum 15 of the crushing elements (such as the above described roller 5) are loaded in resilient manner schematically indicated in FIGS. 1 and 2 by. springs 17 and 18 resp.

In the embodiment illustrated in FIGS. 4 through 8, the plate or strip 1 is fitted with a substantially right-angle flange 1' in order to constitute a right-angle bracket.

In this latter embodiment, the initial guiding cylinder 4 (FIGS. 2 and 4) and the crushing drum 16 (FIGS. 2 and 8) are fitted with peripheral and circular slots 4' and 16' resp. to accommodate the right-angle flange 1' of the plate or strip 1.

Obviously means also are provided to drive the plate or strip 1, namely in this instance a schematically indicated drive motor 19 (FIG. 2) which drives into rotation the cylinder 4 (the roller 5 being idle) and/or at least one of the wheels 8 and 9 of the bending sub-assembly and/or at least one of the crushing drums 15, 16.

In the light of the above described apparatus of the invention, the working of said apparatus and consequently the method of the invention are easily understood.

The plate or strip 1 of FIG. 1, which in this instance is also fitted with a substantially right-angle flange 1', is inserted between the cylinder 4 and the roller 5 and then is driven as elucidated above by the motor 19 (FIG. 2) in the direction of the arrow F (FIG. 3), the flange 1' being received in the circular slot 4'.

After being guided by the alignment guide 7, the plate or strip 1 is slightly bent transversely (FIGS. 2, 3 and 6), while the hoop 3 is continuously deposited into the strip's or plate's channel 2 by means of the guide ramp 11.

The assembly is then re-flattened by the straightening fins 13 and the small support bar 14 (FIGS. 2, 3 and 7) before being made to pass between the crushing drums 15 and 16 of the lips 2*a*, 2*b* of the channel 2 (FIGS. 1, 2, 3 and 8), the flange 1' being received in the slot 16' of the drum 16.

Once fitted in this manner, the plate or strip 1 may then be used as any kind of packing structure that in this manner comprises an integrated fastener.

Using a strip in particular, a protective packing structure in the form of a collar to enclose at least part of a cylindrical object.

Illustratively the end of a pipe or tube may be protected by using a strip fitted with a substantially right-angle flange in the manner discussed above.

What is claimed is:

1. Apparatus for continuously inserting a fastener (3) into a substantially flat and flexible plate or strip (1) to form a packing structure, said plate or strip being fitted with a channel (2) and two lips (2*a*, 2*b*) which partly close said channel, said fastener (3) adapted to be inserted between said lips, where said apparatus is wherein said apparatus comprises:

a bending sub-assembly (8, 9) for slightly bending the strip or plate (1) transversely;

an inserting sub-assembly (11, 12) for inserting the fastener into the channel;

means (15, 16) for re-flattening the plate or strip (1) after insertion of the fastener therein; and means (19) for driving the plate or strip (1) at said channel (2) in the longitudinal direction.

2. Apparatus as claimed in claim 1, wherein the bending sub-assembly includes two superposed bending wheels (8, 9) of which the respective rims exhibit one concave surface and one substantially convex surface, the plate or strip (1) being made to pass between said bending wheels with said channel (2) facing the concave-rim wheel (8).

3. Apparatus as claimed in claim 2, wherein the inserting sub-assembly includes a guide ramp (11) feeding said fastener, the end of said ramp reaching the vicinity of the bending wheels (8, 9) and being configured between said bending wheels; and a circular rib (12) on the concave-rim wheel (8) for pressing in order that said rib (12) may against the fastener (3) during bending.

4. Apparatus as claimed in claim 2, further comprising an initial holding and guiding element for the strip or plate (1), said initial holding and guiding element being configured upstream of the bending sub-assembly as seen in the direction of displacement (F) of said plate or strip and including a cylinder (4) on which runs said plate or strip, and a roller (5) which is adapted to press against the bottom of the channel (2) of said plate or strip (1).

5. Apparatus as claimed in claim 4, wherein an alignment guide in the form of a small bar (7) is configured between the initial holding and guiding element and the bending sub-assembly.

6. Apparatus as claimed in claim 4, further comprising, in the form of crushing drums (15, 16) configured downstream of the means for re-flattening, an element for crushing the lips (2*a*, 2*b*) of the channel (2).

7. Apparatus as claimed in claim 6, wherein the means for driving the plate or strip (1) include at least in part motors (19) driving at least one of the bending wheels (9) of the bending sub-assembly and/or the cylinder (4) of said initial holding and guiding element and/or at least one of the crushing drums (16).

8. Apparatus as claimed in claim 6 for a plate or strip (1) furthermore fitted with a substantially right-angle flange (1') in order to constitute a bracket, wherein the cylinder (4) of the initial holding and guiding element and one of the crushing drums (16) are fitted with peripheral and circular slots (4', 16'), respectively, to receive the substantially right-angle flange (1') of the plate or strip (1).

9. Apparatus as claimed in claim 1, wherein said means for re-flattening the plate or strip (1) includes straightening fins (13) which gradually change from an oblique position to a substantially plane position.

10. Apparatus as claimed in claim 9, further comprising means for holding the fastener and configured above the straightening fins (13) and in the form of a bar (14).

11. Apparatus as claimed in claim 1, further comprising an initial holding and guiding element for the strip or plate (1), said initial holding and guiding element being configured upstream of the bending sub-assembly as seen in the direction of displacement (F) of said plate or strip and including a cylinder (4) on which runs said plate or strip, and a roller (5) which is adapted to press against the bottom of the channel (2) of said plate or strip (1).

12. Apparatus as claimed in claim 11, wherein an alignment guide in the form of a small bar (7) is configured between the initial holding and guiding element and the bending sub-assembly.

13. Apparatus as claimed in claim 1, further comprising, in the form of crushing drums (15, 16) configured downstream of said means for re-flattening, an element for crushing the lips (2*a*, 2*b*) of the channel (2).

14. Apparatus for continuously inserting a fastener into a flexible plate or strip to form a packing structure, said plate or strip having a substantially flat and flexible portion having a channel and two lips which partly close said channel, said fastener adapted to be inserted between said lips, wherein said apparatus comprises:

a feeding device for continuously feeding said plate or strip in a longitudinal direction thereof a first bending device for bending said portion of the strip or plate transversely from an initial state to a bent state, thereby moving said lips apart to open said channel;

an inserting device for inserting the fastener into the opened channel;

a second bending device located downstream of said inserting device for returning portion of the strip or plate from the bent state to the initial state, a bending direction of said second bending device being opposite to that of said first bending device.

15. Apparatus as claimed in claim 14, herein the first bending device includes two superposed bending wheels one of which has a concave rim while the other having a convex rim, said portion of the plate or strip being fed to pass between said bending wheels with said channel facing the wheels having the concave rim.

16. Apparatus as claimed in claim 15, wherein the inserting device includes a guide ramp for feeding said fastener, an end of said ramp reaching the vicinity of the bending wheels and being located between said bending wheels; and a rib located on the wheel having the concave rim for pressing against the fastener.

17. Apparatus as claimed in claim 14, wherein said second bending device includes a straightening fin which gradually changes from a first configuration corresponding to the bent state of said portion of the plate or strip to a second configuration corresponding to the initial state of said portion of the plate or strip.

18. Apparatus as claimed in claim 17, further comprising a bar disposed above aid fin for holding the fastener in the channel.

19. Apparatus as claimed in claim 14, further comprising crushing drums located downstream of the second bending device for crushing the ups of the channel, thereby partially closing the channel to retain the fastener therein.

20. Apparatus as claimed in claim 14, wherein said first bending device and said inserting device are located in such a manner that said portion of the plate or strip is bent and the fastener is inserted into the channel simultaneously.

* * * * *